US006709240B1

(12) United States Patent
Schmalz et al.

(10) Patent No.: US 6,709,240 B1
(45) Date of Patent: Mar. 23, 2004

(54) METHOD AND APPARATUS OF DETECTING LOW FLOW/CAVITATION IN A CENTRIFUGAL PUMP

(75) Inventors: Steven C. Schmalz, Greenfield, WI (US); Russell P. Schuchmann, Grinnell, IA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/065,734

(22) Filed: Nov. 13, 2002

(51) Int. Cl.[7] ..... F04B 49/06

(52) U.S. Cl. ..... 417/44.11; 318/432; 318/433; 318/438; 702/34; 702/58; 702/64; 702/75; 417/45

(58) Field of Search ..... 417/45, 44.1, 44.11; 218/432, 433, 438; 702/34–38, 58, 59, 64, 65, 75–77, 182–184

(56) References Cited

U.S. PATENT DOCUMENTS

| | | | | | |
|---|---|---|---|---|---|
| 4,123,009 | A | * | 10/1978 | Kilpinen | 241/30 |
| 4,909,076 | A | * | 3/1990 | Busch et al. | 73/168 |
| 5,479,824 | A | * | 1/1996 | Torres | 73/602 |
| 5,671,635 | A | * | 9/1997 | Nadeau et al. | 73/168 |
| 5,754,450 | A | * | 5/1998 | Solomon et al. | 702/35 |
| 5,767,780 | A | * | 6/1998 | Smith et al. | 340/648 |
| 6,041,163 | A | * | 3/2000 | Cherry, Jr. | 388/811 |
| 6,260,004 | B1 | * | 7/2001 | Hays et al. | 702/183 |
| 6,308,140 | B1 | * | 10/2001 | Dowling et al. | 702/60 |
| 6,366,862 | B1 | * | 4/2002 | Qian et al. | 702/35 |
| 2002/0123856 | A1 | * | 9/2002 | Eryurek | 702/140 |
| 2002/0161550 | A1 | * | 10/2002 | Bharadwaj et al. | 702/182 |
| 2002/0188423 | A1 | * | 12/2002 | Gross et al. | 702/182 |
| 2003/0060094 | A1 | * | 3/2003 | Motsenbocker | 440/6 |

OTHER PUBLICATIONS

Wallace, et al., "Pump Reliability Improvements through Effective Seals and Coupling Management", Proceedings of 15th International Pump Users Symposium, Mar. 3–5, 1998.

Casada, D., "Examination of Pump Failure Data in the Nucleur Power Industry", Oak Ridge National Laboratory, Proceedings of the Fourth NRC/ASME Symposium on Valve and Pump Testing, Jul. 1996.

Flach, et al., "Analyzing Unacceptable Seal Performance", Proceedings of 15th International Pump Users Symposium, Mar. 3–5, 1998.

Urwin, et al., "Life Cycle Costs for Chemical Process Pumps", Chemical Engineering, Jan. 1998.

Wilkinson, et al., "Cavitation Effects on Pump Thrust Leading to Bearing Failures", Proceedings of 15th International Pump Users Symposium, Mar. 3–5, 1998.

Casada, D., "Using the Motor to Monitor Pump Conditions", Oak Ridge National Laboratory, Date Unknown (but prior to 1999).

Burstein, et al., "Reactor Coolant Pump Testing Using Motor Current Signature Analysis", Oak Ridge National Laboratory, Date Unknown (but prior to 1999).

Kenull, et al., "Diagnostics of Submersible Motor Pumps by Non–Stationary Signals in Motor Current", The 1997 ASME Fluids Engineering Division, Summer Meeting, Jun. 22–26, 1997.

* cited by examiner

*Primary Examiner*—Justine R. Yu
*Assistant Examiner*—Emmanuel Sayoc

(57) ABSTRACT

The present invention is directed to a centrifugal pump wherein voltage and current data are detected from voltage and current sensors in the pump motor. A power signal is then generated from the voltage and current data and spectrally analyzed to determine the low flow or cavitation in the pump. As such, unwanted operational conditions resulting from improper pump operation may be detected and a warning or maintenance flag provided without additional transducers and other instruments on the motor or pump.

20 Claims, 4 Drawing Sheets

METHOD AND APPARATUS OF DETECTING LOW FLOW/CAVITATION IN A CENTRIFUGAL PUMP

BACKGROUND OF INVENTION

The present invention relates generally to centrifugal pumps, and more particularly, to a method and apparatus of detecting low flow and/or cavitation in a centrifugal pump using voltage and current data acquired from voltage and current sensors in the pump motor controller assembly.

Submersible motor centrifugal pumps are commonly used for drinking water supply, irrigation, and de-watering as well as in offshore applications. Typically, both the motor as well as the pump are submerged and installed in deep wells down to 1,000 m. Moreover, motor power often reaches up to 2,000 kW and voltage up to 10,000 V. As a result of the remote location of these pumps, condition monitoring and detection of undesirable conditions at an early stage are often difficult.

Low flow and cavitation in centrifugal pumps may be caused by several conditions. For example, cavitation can result when air bubbles form in low pressure regions inside the pump. A phenomenon typically referenced as vaporization. As the bubbles collapse or degrade, they etch away at the impeller fins in the pump. Over time, this condition, often discernible as a "pumping gravel" sound coming from the pump, can lead to breakdown or failure of the pump. "Low flow" or restricted output of the pump occurs as a result of restriction due to obstructions at the input or output of the pump. Recirculation of fluid within the pump housing can result from such a restriction. The recirculation causes swirling vortices between blades of the impeller. This swirling effect reduces the torque in the pump and ultimately restricts the output of the pump clearly, an undesirable condition.

Because of the location of the submersible pump during operation, it is typically difficult to detect the onset of cavitation or low flow. A number of systems have been developed to detect cavitation or low flow but these systems require additional instrumentation that is integrated with the pump. The additional instrumentation increases the complexity of the pump as well as the costs of manufacturing.

It would therefore be desirable to design a pump assembly wherein low flow and/or cavitation are quickly identified and detected without additional instrumentation in the pump.

BRIEF DESCRIPTION OF INVENTION

The present invention is directed to a centrifugal pump wherein voltage and current data are detected from voltage and current sensors in the pump motor controller to determine low flow and/or cavitation in the pump overcoming the aforementioned drawbacks. A power signal is then generated from the voltage and current data and spectrally analyzed to determine the low flow or cavitation in the pump. As such, unwanted operational conditions resulting from improper pump operation may be detected and a warning or maintenance flag provided without additional transducers and other instruments on the motor or pump.

Accordingly, motor power is used to determine the presence of a low flow and/or cavitation condition in the pump, i.e. a torque loss and vaporization. Power is preferably determined from voltage and current data acquired from a three-phase motor. At initial setup of the pump assembly, a baseline signal is determined from the pump known to be operating in a normal, healthy condition. The baseline signal or data is then used for comparison with equivalent signals derived from operational data so that deviations from normal, healthy operation can be readily identified.

Voltage and current data are collected for a relatively short period of time such as one second and a corresponding power signal is then generated. The power signal is then analyzed with a fast Fourier transform (FFT) or band-pass filtered to locate increased noise levels in the power signal, relative to a baseline signal, within a predetermined frequency range. By comparing the energy, within the frequency range of interest, of the transformed or filtered signal with the baseline signal, increased noise levels indicating the presence of cavitation or low flow conditions can be readily identified. The relative increase in noise level is an indication of the magnitude of the low flow or cavitation. Preferably, a maintenance warning or flag is then provided to an operator or other technician so that, if needed, the pump may be shut down or the operating conditions adjusted to eliminate the cause of the fault condition.

Therefore, in accordance with one aspect of the present invention, a motor control for a motor-driven pump is provided. The controller includes at least one voltage sensor and at least one current sensor and is configured to receive a voltage and a current signal of the pump in operation from the at least one voltage sensor and at least one current sensor. The controller is further configured to determine a power signal from the voltage signal, and the current signal, to generate a real-time spectrum analysis of the power signal and to extract critical features from the spectrum. The controller is also configured to determine at least one of a low flow and a cavitation condition in the pump from the spectrum analysis.

In accordance with another aspect of the present invention, a computer readable storage medium having stored thereon a computer program to detect and signal improper operation of a motor-driven pump is provided. The computer program represents a set of instructions that when executed by a processor causes the processor to determine a real-time power signal of power in a pump motor assembly. The set of instructions further causes the processor to perform a spectrum analysis on the real-time power signal over several time cycles and generate a real-time frequency spectrum therefrom. The computer program then compares real-time data with baseline operation of a system known to be in good operating condition and operating at nominal flow conditions. The computer program then determines differences between the baseline data and the data derived from current operating conditions. If the differences exceed a threshold, the computer program provides an external notification signaling improper operation in the pump.

In accordance with yet a further aspect of the present invention, a method of monitoring proper operation in a centrifugal pump motor includes the step of generating a baseline frequency spectrum of a pump known to be operating properly. The method further includes the step of generating a real-time frequency spectrum of the pump in operation from a power signal derived from voltage and current signals acquired from sensors in a motor of the pump, then extracting from this spectrum the energy contained in a prescribed frequency range. This energy is then compared to that obtained from the baseline frequency spectrum and an undesirable pump operating condition is determined therefrom. If an undesirable condition exists, a signal indicating the presence of the condition is provided.

Various other features, objects, and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
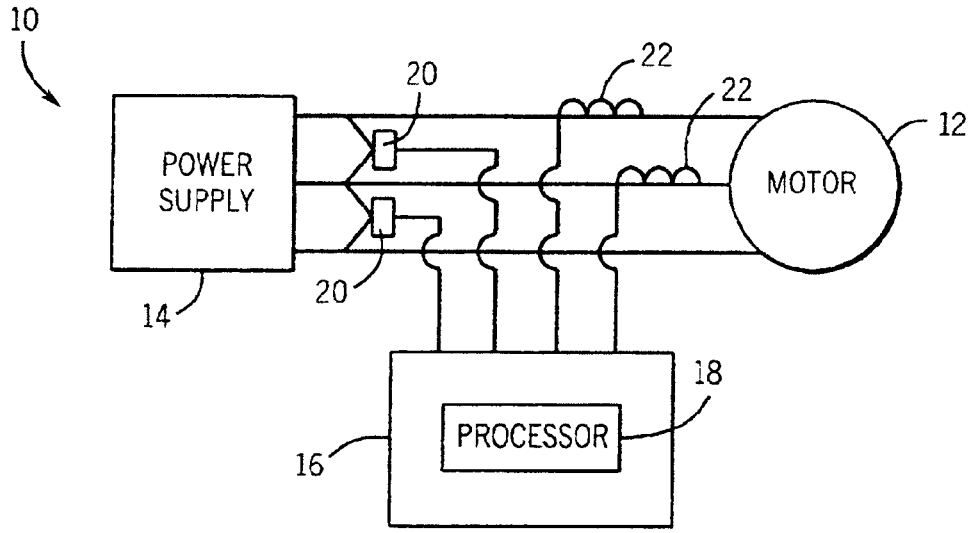
FIG. 1 is a schematic representation of a motor and controller assembly for a centrifugal pump.

The present invention is related to the detection of low flow and/or cavitation conditions in a centrifugal pump having a three-phase motor. In FIG. 1 a motor assembly for a centrifugal pump is shown. Motor assembly 10 includes a motor 12 that receives power from a power supply 14. The assembly also includes a controller 16 used to monitor as well as control operation of the motor. The controller 16 includes a processor 18 that, as will be described in greater detail with respect to FIGS. 2–5, implements an algorithm to determine low flow and/or cavitation in the centrifugal pump based on voltage and current data. Motor controller assembly 10 further includes a pair of voltage sensors 20 and a pair of current sensors 22. As is generally known, voltage and current data may be acquired from only two of the phases of a three-phase motor as voltage and current data for the third phase may be extrapolated from the voltage and current data of the monitored two phases. While the present invention will be described with respect to a three-phase motor, the present invention is equivalently applicable to a single-phase motor.

Figure 2:
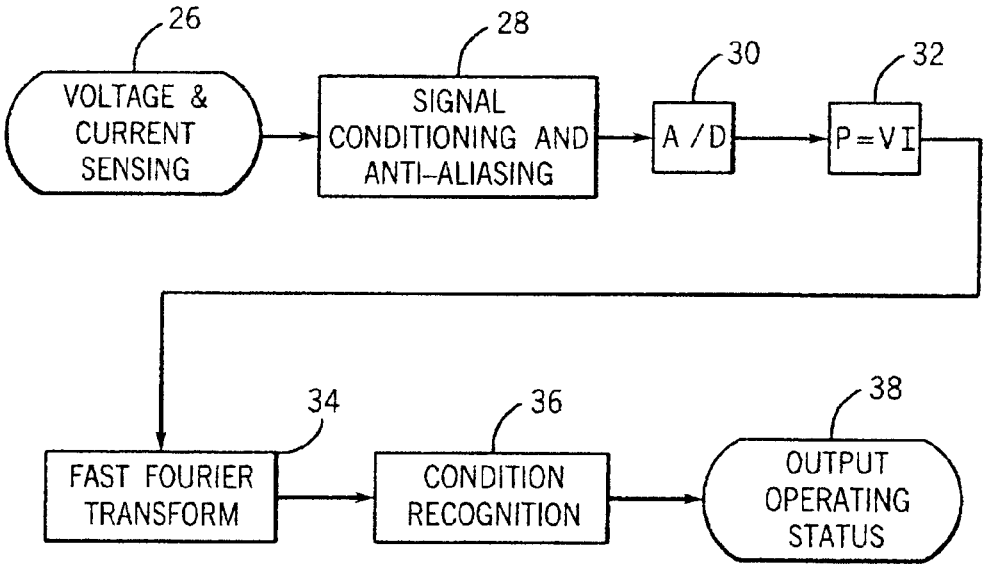
FIG. 2 is a flow chart generally setting forth the steps of detecting low flow and/or cavitation in a centrifugal pump in accordance with the present invention.

Referring now to FIG. 2, a general overview of detecting and determining the presence of low flow and/or cavitation in a centrifugal pump is shown. The process 24 employs an FFT to generate a spectrum analysis of a power signal based on voltage and current data acquired from sensors in the pump motor. The process of detecting a low flow and/or cavitation condition in a centrifugal pump using an FFT begins with the acquisition of voltage and current data 26 using voltage and current sensors present in the motor controller assembly. By acquiring the voltage and current data directly from voltage sensors in the motor controller, it is unnecessary to incorporate additional instrumentation to acquire the voltage and current data as the motor controller typically includes voltage and current sensors. Once the voltage and current signals are acquired, the signals are conditioned at 28. Signal conditioning the voltage and current signals includes amplification, buffering, and anti-aliasing of the signals. Once the voltage and current signals are properly conditioned, they are input into an analog-to-digital converter 30 for sampling. From the sampled voltage and current signals, a power signal or calculation is determined at 32. The power signal is determined by multiplying the voltage values and the current values. As a result, a power signal illustrating power in the motor as a function of time may be readily generated. The calculated power signal then undergoes an FFT at 34 to generate a frequency spectrum. By applying an FFT to the power signal, a frequency spectrum can be generated and features of the spectrum compared to those of a baseline frequency spectrum. Based on this comparison 36, an output signal signaling either a low flow and/or cavitating condition in the pump may be output at 38. The output may take a number of forms including audio and visual warnings and shut down of the pump.

Figure 3:
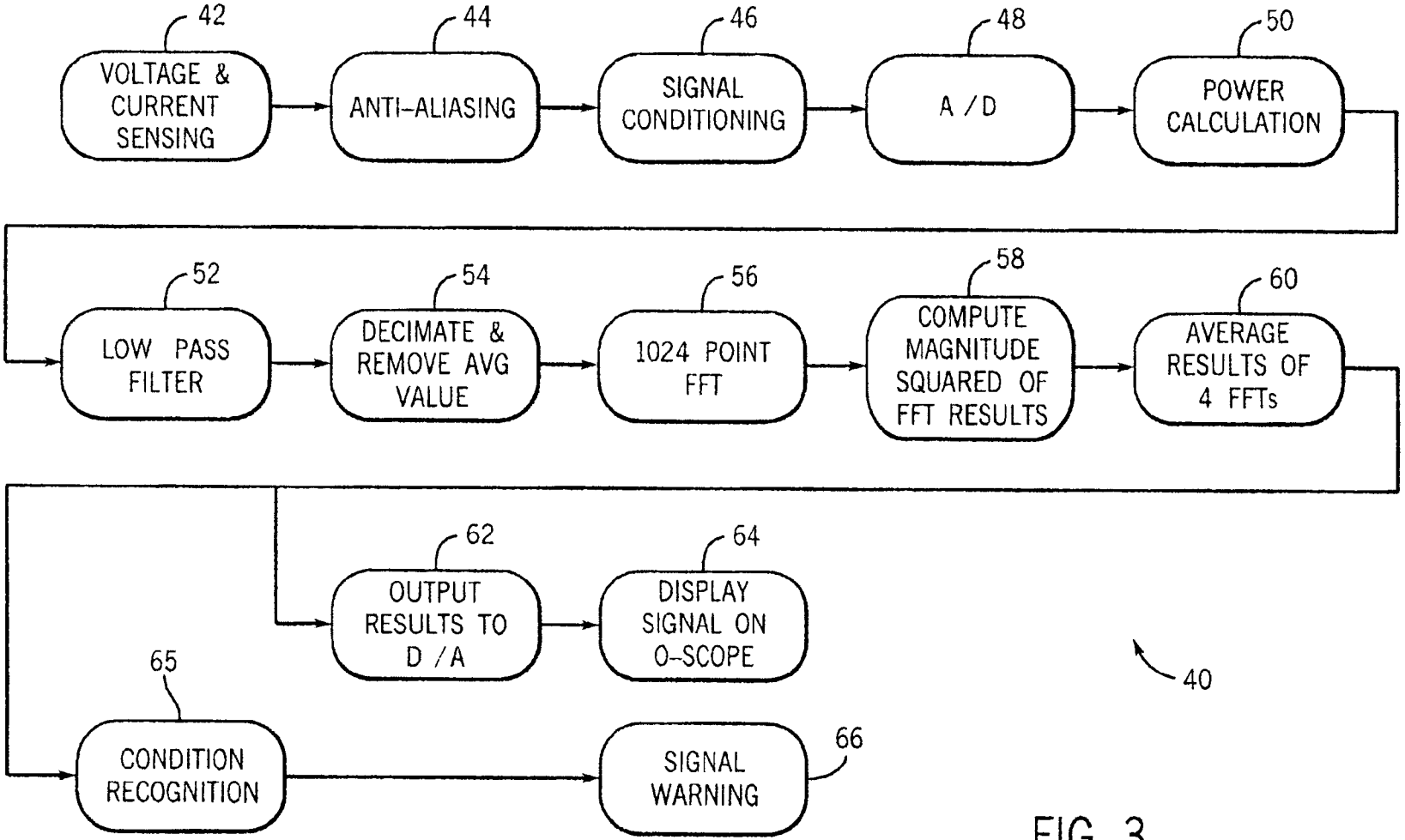
FIG. 3 is a flow chart setting forth in greater detail that shown in FIG. 2.

Referring now to FIG. 3, the specifics of a low flow/cavitation detection scheme utilizing an FFT are shown. The algorithm or process 40 provides an efficient mechanism to calculate the FFT of motor power and compare spectral energy within a band of frequencies to thresholds established during setup when the pump was known to be operating normally or at or near its best efficiency point. These thresholds or baseline data are acquired during initial setup of the pump motor under a variety of normal operating conditions so that nuances relative to each pump are taken into account when determining the basepoint of operation. Simply, each pump is modeled to determine a baseline data of operation so that variances over time can be readily identified relative to the known healthy and normal operation of the pump.

As previously described, voltage and current data is acquired from voltage and current sensors in the motor starter for the pump motor. Specifically, two line-to-line voltages with respect to a common node and line currents for those two lines of a three-phase induction motor are acquired at 42. The voltage and current data are then input to an anti-aliasing filter at 44 that provides at least 40 dB of attenuation at a frequency that is one-half the sampling rate. It is recommended that the anti-aliasing filter have less than one dB of pass-band ripple. Preferably, the cutoff frequency should be approximately 1 kHz. The anti-aliased signals are then conditioned at 46. The conditioned signals are then input to an analog-to-digital converter and sampled at a sampling rate of approximately 5 kHz. The sampled signals are then input to a power calculation means 50.

The power calculation is preferably a three-phase calculation done "on the fly". That is, the power of the pump motor is determined in real-time as the data is acquired. The power is determined by treating one of the motor terminals as a common node and then multiplying the line-to-line voltages with respect to that node by the respective line current. Following the power calculation, the power signals are filtered in real-time at 52 and decimated to a 1024 point dataset which is stored in memory to be used by the FFT at 54. Since the power has a relatively large average value relative to the components of interest, the filter output must be allowed to reach this average value before the acquired data is used for FFT calculations. As will be described in greater detail below, a steady state analysis is performed to ensure that the filter output has reached the average value before the data set used for FFT calculations is saved.

Filtering of the power signal is done at 52 by an eighth order low pass elliptic filter with a cutoff frequency of 90 Hz, pass-band ripple of less than one dB, and attenuation of 60 dB at 180 Hz. This filtering is required to eliminate aliasing when the data is decimated to the final sampling frequency. In order to provide an FFT that would be useful in assessing a variety of diagnostic conditions, the cutoff frequency is chosen to permit sensing signals as high as 120 Hz, or about twice the running frequency of a two-pole motor operating on a 60 Hz line. Preferably, the data originally sampled at approximately 5 kHz is decimated at 54 by a factor of 25 to produce an effective sampling rate of about 213.33 Hz. This choice is based on several factors. For example, the data set for an efficient FFT must be of length to $2^n$ to produce a spectrum with quality definition. Where fault conditions other than cavitation are to be examined, it is also desirable to distinguish between leakage at the power frequency and its harmonics and signals related to the running speed of the motor. For example, for a two-pole motor, these are only separated by the slip. frequency. Thus, it is desirable to have at least 0.4 Hz of spectral resolution, defined by:

$$\text{resolution}=Fs/Np \quad \text{(Eqn. 1)},$$

where Fs is the sampling rate and Np is the number of points in the data set. For an Fs of 213.33 and an Np of 1024, the resolution is about 0.208 Hz. An additional factor to consider is avoiding loss of data resolution when executing a fixed point FFT. To do so, it is desirable to use a minimum data set length. The parameters should be chosen so as to lead to reasonable results with relatively short data set lengths. Additionally, it is desirable to avoid the use of a window which would ultimately require additional multiply operations.

Because the power has a large average value compared to the signals of interest, the average value is removed from the data set that is decimated and stored in 54 for use by the FFT process. This eliminates a very large spectral spike at zero frequency as well as to reduce the numerical range that must be dealt with in the FFT procedure thereby permitting the use of fixed point processing.

Referring again to FIG. 3, the decimated signal then undergoes a 1024 point FFT at 56. Preferably, a digital signal processor is used to apply the FFT and yields results and spectrum values that are the square of the actual amplitude of the signal. Since the square root operation is not trivial, the squared values are used in evaluating the spectrum 58. Because an FFT for a given data set will show some random variation and spectral amplitude when compared to FFTs from other data sets gathered under conditions that are nominally the same, it is preferable to diminish this randomness by averaging several FFTs together. As a result, preferably, four FFTs are averaged at 60 in accordance with the present invention. Because RAM may often be limited, the result of four separate FFTs prior to computing the average is not stored. That is, the same spectral buckets used to collect results for all four FFTs are used and an average is performed at the end. The average results of the four FFTs are then analyzed to include the spectrum between 5 and 25 Hz. This frequency range has been empirically determined to be the range that noise in an instantaneous power signal increases if pump flow is impeded. The FFT data within the range are then input to a digital-to-analog converter at 62. The resultant signal can then be displayed on an oscilloscope or computer screen for analysis at 64. Additionally, the spectral energy within the band of about 5 to 25 Hz is calculated at 65 and a warning signal or alarm 66 is triggered if the noise energy in this frequency band exceeds a threshold. As such, the noise energy in the frequency band is compared to a baseline signal.

A single FFT could also be implemented rather than averaging four FFTs provided an adequate number of data points are provided to generate a reliable and usable result.

The frequency spectrum of the real-time power signal and the baseline can be displayed on a console such that an operator or technician can determine a low flow and/or cavitating condition based on visual inspection of the 5–25 Hz frequency range. Other indicators such as warning lights and audio warnings may also be implemented when the acceptable baseline energy for the 5–25 Hz range is exceeded on a persistent basis. A two-level warning system may be implemented where a condition that narrowly exceeds the baseline actuates a low priority warning light whereas a condition that is significantly higher than the baseline triggers an urgent alarm.

As previously described, a steady state analysis is implemented to ensure the integrity of the data acquisition. That is, the data is evaluated for a steady state operating condition by evaluating the average power of the first half of the data set versus that of the second half. For a steady state condition to be present, the average power for the two halves is required to be within one percent of each other. If a non-steady state condition is encountered, the entire FFT data set is discarded and the process starts anew with a new group of four FFTs.

Figure 4:
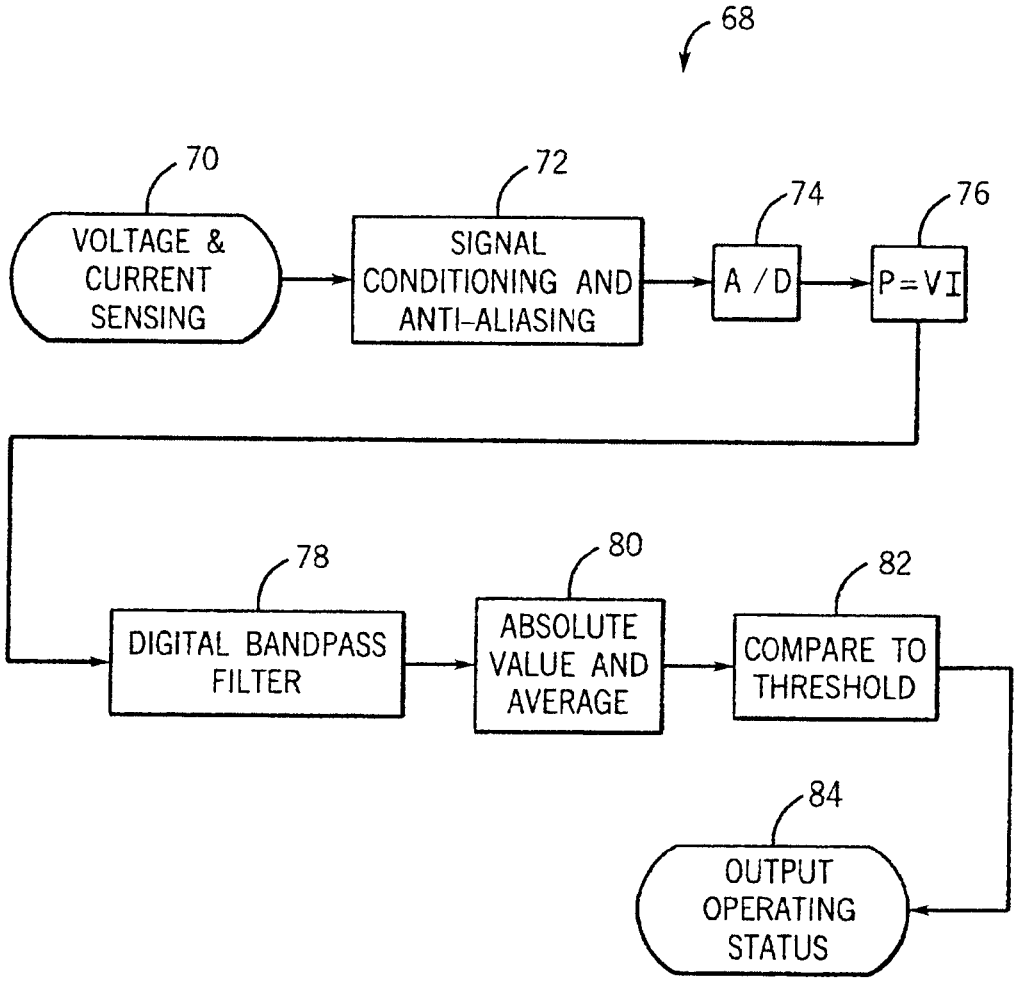
FIG. 4 is a flow chart generally setting forth the steps of detecting low flow and/or cavitation in a centrifugal pump in accordance with another embodiment of the present invention.

Referring now to FIG. 4, an alternate algorithm for detecting low flow and/or cavitation in a motor pump utilizes a digital band-pass filter as opposed to an FFT to generate an output that represents only the signal content of the 5 to 25 Hz range of the power signal. Because a filter-based algorithm has less computational burden than an FFT, the filter-based approach is particularly applicable to low cost product implementations. However, if a given motor control product already implements another FFT-based algorithm associated with other control parameters of the motor, the FFT approach may be preferred.

Similar to the FFT algorithm, the digital band-pass algorithm 68 begins with the acquisition of voltage and current data 70. The voltage and current data or signals are then conditioned and anti-aliased at 72. The condition signals are then input to an analog-to-digital converter 74 for sampling. Using the sampled signals, a power signal is derived at 76. Similar to the FFT approach, the power signal is derived by multiplying the voltage and current data. The power signal is then input to a digital band-pass filter 78. By first low-pass filtering the motor signal, it is possible to allow for decimation without aliasing. An average of the absolute value of the output of the digital band-pass filter is then determined at 80 and subsequently compared to a series of thresholds at 82. Comparing the averaged absolute value of the filtered real-time power signal to that obtained from the baseline power signal makes it possible to readily determine the presence of anomalies in the pump, i.e. low flow and cavitation. At 84, an operating status of the pump is output. For example, if the pump is operating properly, a "green" or go signal indicative of normal operation may be provided. A "yellow" or cautionary warning could be provided if the onset of low flow or cavitation is detected and a "red" or shutdown warning could be provided if the pump is operating under severe low flow and/or cavitation conditions warranting a shutdown of the pump or urgent requirement to correct operating conditions.

Figure 5:
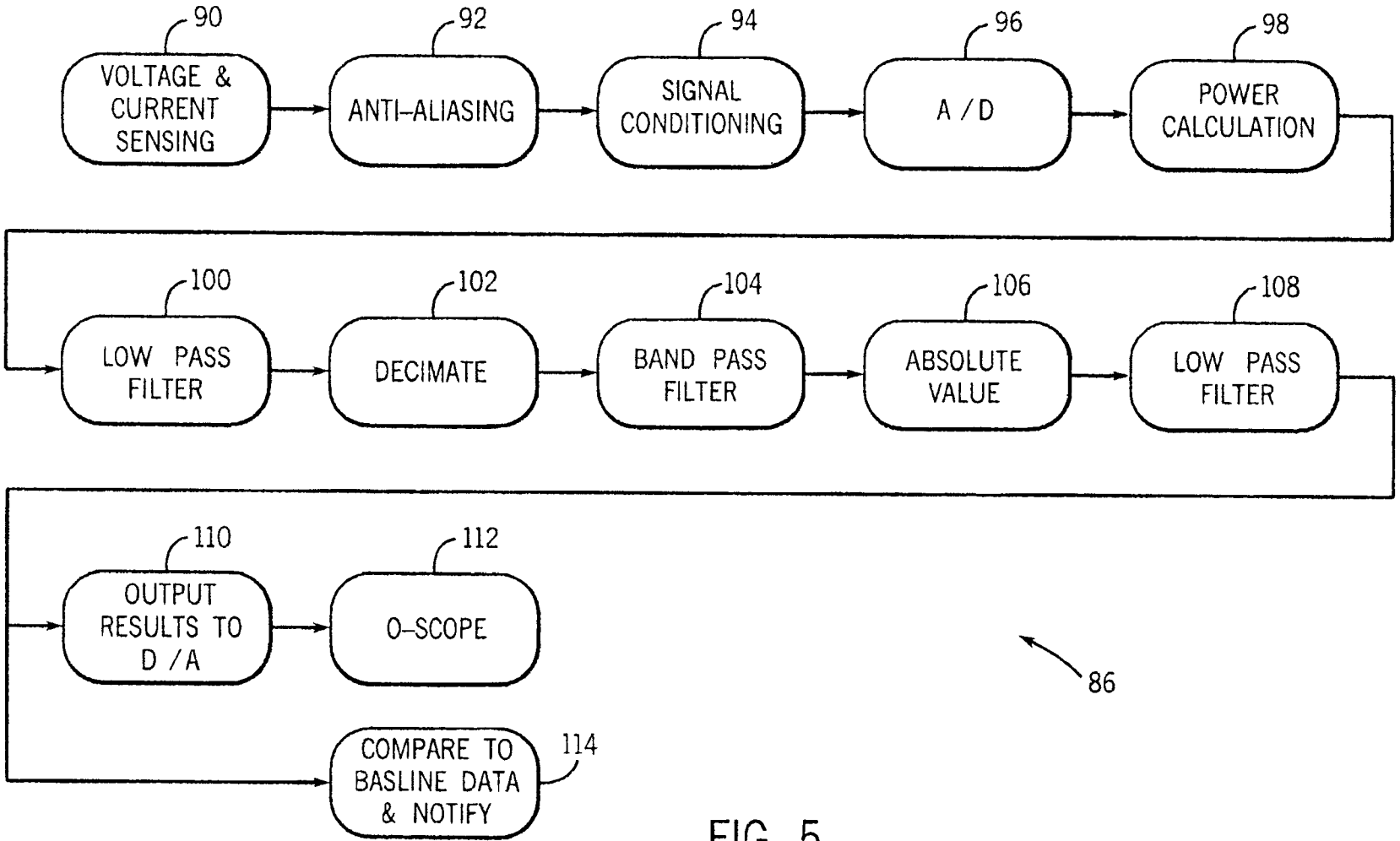
FIG. 5 is a flow chart setting forth in greater detail that shown in FIG. 4.

Referring now to FIG. 5, a process 86 detailing specifically the filter-based algorithm heretofore described is shown. The process 86 begins with the acquisition of voltage and current data 90 and the subsequent anti-aliasing 92 and signal conditioning 94 of the voltage and current signals. The conditioned signals are then input to an analog-to-digital converter 96 whereupon a power calculation is implemented at 98 to generate a power signal from the voltage and current signals. Preferably, a three-phase power calculation is made. The power signal is then input to a low-pass filter 100. Preferably, the low-pass filter is a sixth order Chebyshev type-one filter. The low-pass filter signal is then decimated at 102 by a factor of ten resulting in a sampling of 500 Hz. Decimation reduces the pass-band selectivity of the subsequent band-pass filter stage thereby allowing implementation in a 16-bit fixed point digital signal processor architecture. The decimated signal is then input to a sixth order Chebyshev type-one band-pass filter at 104. The band-pass filter stage isolates most frequencies in the 5–15 Hz range (approximate 3 dB pass-band). In one embodiment, the range of interest does not include the 15–30 Hz since the digital band-pass filter must adequately attenuate frequencies above 25 Hz without an overly complex transfer function. At 106, the absolute value of the filter signal is then computed and averaged using a low-pass Butterworth filter 108 with a three dB rolloff at 0.25 Hz. The averaged signal (output of the low-pass filter) is nearly proportional in magnitude to the spectral noise resulting from low flow and/or cavitating operation. The output of the low-pass filter is then input to a digital-to-analog converter at 110 whereupon the signal may be displayed on an oscilloscope or console at 112. Displaying the output of the digital-to-analog converter on an oscilloscope allows an operator or technician to visually view the power signal relative to a baseline signal to determine low flow and/or cavitation in the pump. Other graphical displays could also be used to "display" the signal. For example, a comparison between the real-time signal and a baseline signal could be graphically shown on a computer screen. Additionally, a notification light or audio alarm may be activated 114 based on the differences between the real-time power signal and the baseline signal. Accordingly, the low pass filtered signal is compared to baseline data of the pump operating at or near its last efficiency point. If the differences between the filtered signal and the baseline signal are sufficient, a warning is provided such as activation of a light or alarm.

Therefore, in accordance with one embodiment of the present invention, a motor control for a motor-driven pump is provided. The controller includes at least one voltage sensor and at least one current sensor and is configured to receive a voltage and a current signal of the pump in operation from the at least one voltage sensor and at least one current sensor. The controller is further configured to determine a power signal from the voltage signal and the current signal and generate a real-time spectrum analysis of the power signal. The controller is also configured to determine at least one of a low flow and a cavitation condition in the pump from the spectrum analysis.

In accordance with another embodiment of the present invention, a computer readable storage medium having stored thereon a computer program to detect and signal improper operation of a motor-driven pump is provided. The computer program represents a set of instructions that when executed by a processor causes the processor to determine a real-time power signal of power in a pump motor assembly. The set of instructions further causes the processor to perform a spectrum analysis on the real-time power signal over several time cycles and generate a real-time frequency spectrum therefrom. The computer program then compares features of the real-time frequency spectrum to those from a baseline frequency spectrum. The computer program then determines differences between the baseline data and that from the real-time frequency spectrum and if the differences exceed a threshold, provides an external notification signaling improper operation in the pump.

In accordance with yet a further embodiment of the present invention, a method of monitoring proper operation in a centrifugal pump motor includes the step of generating a baseline frequency spectrum of a pump known to be operating properly. The method further includes the step of generating a real-time frequency spectrum of the pump in operation from a power signal derived from voltage and current signals acquired from sensors in a motor of the pump. Portions of the real-time frequency spectrum are then compared to the baseline frequency spectrum and an undesirable pump operating condition is determined therefrom. If an undesirable condition exists, a signal indicating the presence of the condition is provided.

The present invention has been described in terms of the preferred embodiment, and it is recognized that equivalents, alternatives, and modifications, aside from those expressly stated, are possible and within the scope of the appending claims.

What is claimed is:

1. A motor controller for a pump, the controller configured to:

acquire voltage and current signals from at least one voltage sensor and at least one current sensor of a motor starter;

determine a power signal in the motor starer from the voltage and current signals;

perform a spectrum analysis on the power signal;

compare the analyzed power signal to a base signal; and from the comparison, determine at least one of low flow and cavitation in the pump.

2. The motor controller of claim 1 further configured to perform the spectrum analysis with a fast Fourier transform.

3. The motor controller of claim 1 further configured to perform the spectrum analysis with band-pass filtering.

4. The motor controller of claim 1 further configured to detect excessive noise in the power signal as an indication of the at least one of low flow and cavitation.

5. The motor controller of claim 1 further configured to model operation of the pump under acceptable operating conditions to determine the base signal.

6. The motor controller of claim 1 further configured to perform the spectrum analysis over several cycles and compare the analyzed power signal over several cycles to determine the at least one of low flow and cavitation in the pump.

7. A computer readable storage medium having stored thereon a computer program to determine improper operation of a pump and representing a set of instructions that when executed by a processor causes the processor to:

determine a real-time power signal of power in a pump motor assembly;

perform a spectrum analysis on the real-tine power signal over several time cycles and generate a real-time signal frequency spectrum therefrom;

compare the real-time frequency spectrum to a baseline frequency spectrum;

determine differences between the baseline frequency spectrum and the real-time frequency spectrum in a frequency range of interest; and if the differences exceed a threshold, output a notification signal.

8. The computer readable storage medium of claim 7 wherein the set of instructions further causes the computer to activate a warning light if the differences exceed the threshold.

9. The computer readable storage medium of claim 7 wherein the set of instructions further causes the processor to apply a fast Fourier transform on the real-time power signal to generate the real-tine frequency spectrum.

10. The computer readable storage medium of claim 7 wherein the set of instructions further causes the processor to input the real-time power signal to a band pass filter to extract the real-time frequency spectrum in the frequency range of interest.

11. The computer readable storage medium of claim 7 wherein the set of instructions further causes the processor to determine one of low flow and cavitation in the pump based on spectral energy differences between the real-time power signal and a baseline power signal.

12. The computer readable storage medium of claim 11 wherein the set of instructions further causes the processor to limit the comparison to spectral energy differences in the 5–25 $H_z$ range.

13. The computer readable storage medium of claim 7 wherein the set of instructions causes the processor to determine the real-time power signal from voltage and current signals acquired from at least two phases of a three-phase motor.

14. The computer readable storage medium of claim 7 wherein the differences indicate undesirable noise in the real-time power signal.

15. A method of monitoring proper operation of a centrifugal pump comprising the steps of:

generating a baseline frequency spectrum of a pump known to be operating properly;

generating a real-time frequency spectrum of the pump in operation from a power signal derived from voltage and current signals acquired from sensors in a motor of the pump;

comparing the real-time frequency spectrum and the baseline frequency spectrum and determining any undesirable pump operating condition therefrom; and signaling presence of the undesirable pump operating condition.

16. The method of claim 15 wherein the step of generating the real-time frequency spectrum includes the steps of acquiring voltage and current signals from at least two phases from the motor and anti-aliasing the acquired signals.

17. The method of claim 16 wherein the step of generating the real-time frequency spectrum includes the step of applying a fast Fourier transform to the power signal.

18. The method of claim 16 wherein the step of generating the real-time frequency spectrum includes the step of band pass filtering the power signal.

19. The method of claim 16 further comprising the steps of generating the real-time frequency spectrum over several time periods, determining an average of the several time periods, and comparing the average to the baseline frequency spectrum.

20. The method of claim 16 wherein noise within a selected frequency band of the real-time frequency spectrum exceeding a threshold is indicative of the undesirable pump operating condition.

* * * * *